US012716657B2

(12) United States Patent
Ahamed et al.

(10) Patent No.: US 12,716,657 B2
(45) Date of Patent: Aug. 25, 2026

(54) HEAT PIPE

(71) Applicant: Fujikura Ltd., Tokyo (JP)

(72) Inventors: Mohammad Shahed Ahamed, Tokyo (JP); Harutoshi Hagino, Tokyo (JP); Akihiro Takamiya, Tokyo (JP); Yoji Kawahara, Tokyo (JP); Tsuyoshi Ogawa, Tokyo (JP)

(73) Assignee: Fujikura Ltd., Tokyo (JP)

( * ) Notice: Subject to any disclaimer, the term of this patent is extended or adjusted under 35 U.S.C. 154(b) by 190 days.

(21) Appl. No.: 18/029,002

(22) PCT Filed: Jun. 23, 2021

(86) PCT No.: PCT/JP2021/023781
§ 371 (c)(1),
(2) Date: Mar. 28, 2023

(87) PCT Pub. No.: WO2022/102163
PCT Pub. Date: May 19, 2022

(65) Prior Publication Data

US 2023/0366634 A1 Nov. 16, 2023

(30) Foreign Application Priority Data

Nov. 16, 2020 (JP) ..... 2020-190013

(51) Int. Cl.
*F28D 15/04* (2006.01)

(52) U.S. Cl.
CPC ..... *F28D 15/04* (2013.01)

(58) Field of Classification Search
CPC .... F28D 15/04; F28D 15/046; F28D 15/0233; H01L 23/427
(Continued)

(56) References Cited

U.S. PATENT DOCUMENTS 7,137,442 B2 * 11/2006 Kawahara ..... F28D 15/0233 165/104.21
2005/0241807 A1 * 11/2005 Jankowski ..... F28D 15/0208 165/104.26
(Continued)

FOREIGN PATENT DOCUMENTS

CN 101616786 A 12/2009
JP H11294980 A 10/1999
(Continued)

OTHER PUBLICATIONS

English translation of wo-2014157147A1 (Year: 2014).*
(Continued)

*Primary Examiner* — Tho V Duong
(74) *Attorney, Agent, or Firm* — Osha Bergman Watanabe & Burton LLP

(57) ABSTRACT

A heat pipe includes a flat container having an internal space in which a working fluid is sealed and a flat surface facing the internal space, and a wick disposed in the internal space. The wick includes a first wick having a plurality of first voids and a second wick having a plurality of second voids. The first wick rises from the flat surface and is fixed to the flat surface. The second wick is formed of a sintered body of powders and covers a surface of the first wick. Each of the plurality of second voids is smaller on average than each of the plurality of first voids.

5 Claims, 2 Drawing Sheets

(58) Field of Classification Search
USPC ..... 165/104.26
See application file for complete search history.

(56) References Cited

U.S. PATENT DOCUMENTS

| | | | | |
|---|---|---|---|---|
| 2006/0162907 | A1* | 7/2006 | Wu | F28D 15/046 165/146 |
| 2007/0240858 | A1* | 10/2007 | Hou | F28D 15/046 165/146 |
| 2015/0204617 | A1* | 7/2015 | Thanhlong | F28D 15/0233 165/104.26 |
| 2016/0010927 | A1* | 1/2016 | Ahamed | F28D 15/0233 165/104.26 |

FOREIGN PATENT DOCUMENTS

| | | | | | |
|---|---|---|---|---|---|
| JP | 2009276022 | A | | 11/2009 | |
| JP | 2012229879 | A | | 11/2012 | |
| JP | 2013002640 | A | | 1/2013 | |
| JP | 2013011363 | A | * | 1/2013 | F28D 15/0233 |
| JP | 2014115052 | A | * | 6/2014 | F28D 15/0233 |
| JP | 2016020788 | A | | 2/2016 | |
| WO | WO-2014157147 | A1 | * | 10/2014 | F28D 15/046 |

OTHER PUBLICATIONS

English translation of the International Search Report issued in corresponding International Application No. PCT/JP2021/023781, mailed Jul. 27, 2021 (2 pages).
"Principles and Design of Heat Exchangers", 2nd Edition, Residual Progenitor et al., Oct. 2019, p. 266 (10 pages).
Office Action issued in corresponding Chinese Patent Application No. 202180057817.0, dated Apr. 10, 2026 (6 pages).

* cited by examiner

| | MAXIMUM AMOUNT OF HEAT TRANSPORT Qmax [W] | THERMAL RESISTANCE IN EVAPORATION SECTION [°C/W] | THERMAL RESISTANCE OTHER THAN EVAPORATION SECTION [°C/W] | TOTAL RESISTANCE [°C/W] |
|---|---|---|---|---|
| CONVENTIONAL WICK | 42 | 0.096 | 0.071 | 0.167 |
| NEW WICK | 54 | 0.029 | 0.051 | 0.080 |

HEAT PIPE

TECHNICAL FIELD

The present invention relates to a heat pipe.

Priority is claimed on Japanese Patent Application No. 2020-190013 filed on Nov. 16, 2020, the content of which is incorporated herein by reference.

BACKGROUND

Patent Document 1 below discloses a flat heat pipe. This heat pipe includes a wick in which a plurality of fine wires are bundled. The wick rises from a flat surface inside a flat container and is fixed to the flat surface by sintering.

Patent Document

[Patent Document 1] Japanese Unexamined Patent Application, First Publication No. 2012-229879

When a wick is a bundle of fine wires, the wick is capable of exhibiting a high capillary force and reducing a pressure loss of a condensed working fluid. On the other hand, there is room for improvement as follows. In the wick described above, an evaporation area of the working fluid is reduced, and thermal resistance of the working fluid in an evaporation section increases. Also, since a maximum amount of heat transport of a heat pipe is governed by a capillary radius of the wick, there is a limit to the maximum amount of heat transport.

SUMMARY

One or more embodiments of the present invention improve performance of a heat pipe.

A heat pipe according to one or more embodiments of the present invention includes a flat container having an internal space in which a working fluid is sealed and a flat surface facing the internal space, and a wick provided in the internal space, the wick including a first wick having a plurality of first voids and a second wick having a plurality of second voids, the first wick rising from the flat surface and being fixed to the flat surface, the second wick being formed of a sintered body of powders and covering a surface of the first wick, each of the plurality of second voids being smaller on average than each of the plurality of first voids. According to this configuration, the surface of the first wick is covered with the sintered body of powders (the second wick) having the second voids finer than the first voids. A surface of the second wick has unevenness formed to be finer than the surface of the first wick, and thus it is possible to increase an evaporation area of the working fluid and it is possible to reduce thermal resistance. Also, since the condensed working fluid flows not only in the first wick (the first voids) but also in the second wick (the second voids), a maximum amount of heat transport increases.

In the heat pipe described above, the first wick may be formed of a plurality of fine wires bundled together.

In the heat pipe described above, diameters of the fine wires may be larger than particle sizes of the powders.

In the heat pipe described above, when a direction perpendicular to the flat surface is referred to as a thickness direction, a maximum value of a dimension of the first wick in the thickness direction may be larger than a dimension of the second wick in the thickness direction.

In the heat pipe described above, the first wick may extend in the internal space from an evaporation section in which the working fluid evaporates to a condensation section in which the working fluid condenses, and the second wick may cover the surface of the first wick at least in the evaporation section.

According to one or more embodiments of the present invention, it is possible to improve performance of the heat pipe.

DETAILED DESCRIPTION

Hereinafter, a heat pipe according to one or more embodiments of the present invention will be described with reference to the drawings.

Figure 1:
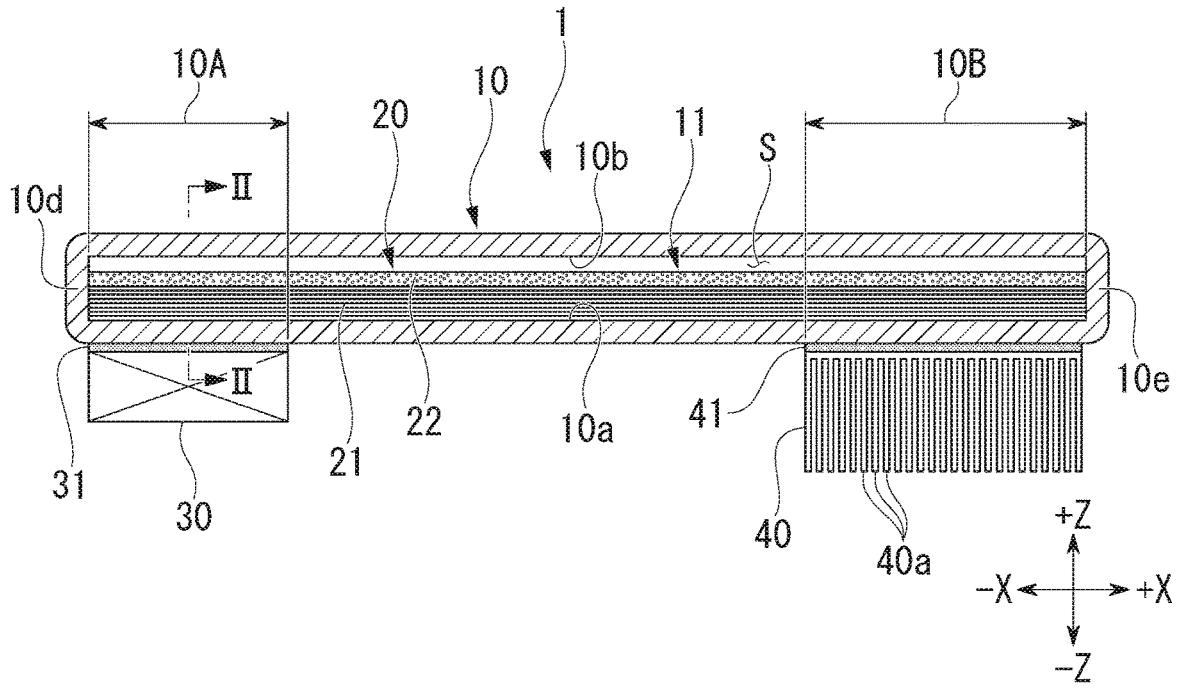
FIG. 1 is a view illustrating a cross-sectional configuration of a heat pipe according to one or more embodiments.
Figure 2:
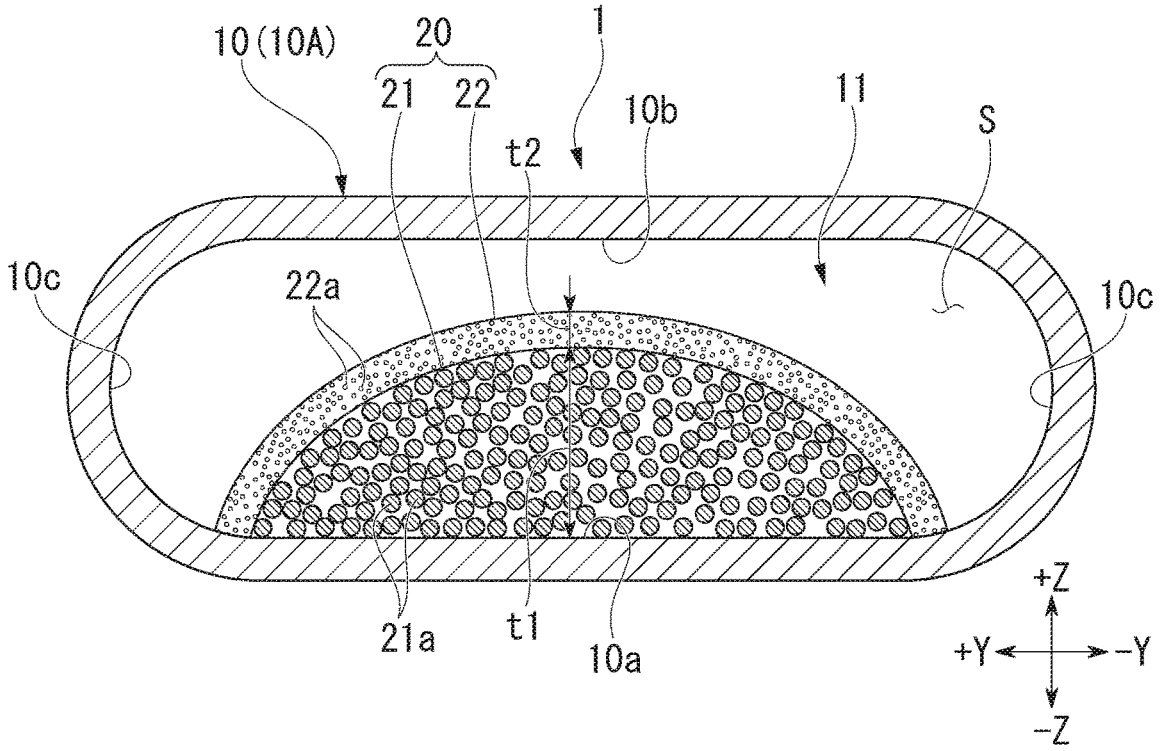
FIG. 2 is a cross-sectional view along the cross section II-II of the heat pipe illustrated in FIG. 1.

FIG. 1 is a cross-sectional configuration view of a heat pipe 1 according to one or more embodiments. FIG. 2 is a cross-sectional view along the cross section II-II of the heat pipe 1 illustrated in FIG. 1. The heat pipe 1 is a heat transport element that utilizes latent heat of a working fluid. This heat pipe 1 includes a container 10 having an internal space S in which the working fluid is sealed, and a wick 20 provided in the internal space S of the container 10. The container 10 has a first flat surface 10*a* and a second flat surface 10*b* parallel to each other. The container 10 has a first end portion 10*d* and a second end portion 10*e*.

Here, in one or more embodiments, an XYZ orthogonal coordinate system is set to describe a positional relationship of respective components. Of directions perpendicular to the first flat surface 10*a*, a direction from the first flat surface 10*a* toward the second flat surface 10*b* is referred to as a +Z direction (upward direction), and a direction opposite to the upward direction is referred to as a −Z direction (downward direction). In a case in which the +Z direction and the −Z direction are not distinguished from each other, the directions will be simply referred to as a Z direction (thickness direction Z). Of directions perpendicular to the thickness direction Z, a direction from the first end portion 10*d* toward the second end portion 10*e* is referred to as a +X direction, and a direction opposite to the +X direction is referred to as a −X direction. In a case in which the +X direction and the −X direction are not distinguished from each other, the directions will be simply referred to as an X direction (longitudinal direction X). A direction perpendicular to both the thickness direction Z and the longitudinal direction X is referred to as a Y direction (width direction Y).

The working fluid is a heat transport medium made of a well-known phase-change material, and changes phase between a liquid phase and a gas phase in the container 10. For example, water (pure water), alcohol, ammonia, or the like may be employed as the working fluid. Further, regarding the working fluid, a case of a liquid phase may be described and explained as "liquid," and a case of a gas phase may be described and explained as "vapor." Also, in a case in which the liquid phase and the gas phase are not particularly distinguished from each other, they will be described and explained as a working fluid. Further, in the flat-type heat pipe 1 of one or more embodiments, water may be employed as the working fluid.

The container 10 is an airtight hollow pipe in which the first end portion 10*d* and the second end portion 10*e* are closed. In the heat pipe 1 used for heat transport between positions separated from each other, a hollow pipe (pipe) is utilized for the container 10. Since the container 10 needs to transfer heat between the inside (internal space S) and the outside of the container 10, the container 10 may be formed of a material with high thermal conductivity. The container 10 may be formed of a metal pipe such as, for example, a copper pipe, an aluminum pipe, or a stainless steel pipe.

As illustrated in FIG. 2, the container 10 is formed in a flat shape in which a dimension in the width direction Y is larger than a dimension in the thickness direction Z. The first flat surface 10*a* and the second flat surface 10*b* parallel to each other, and a pair of curved surfaces 10*c* connecting both ends of the two flat surfaces 10*a* and 10*b* are formed in the inner surface of the container 10. In the present specification, the first flat surface 10*a* and the second flat surface 10*b* may be simply referred to as a flat surface without particularly distinguishing them from each other. The internal space S is a space surrounded by the first flat surface 10*a*, the second flat surface 10*b*, and the curved surfaces 10*c*. The first flat surface 10*a* and the second flat surface 10*b* face the internal space S. Further, the curved surfaces 10*c* are not limited to a semi-circular shape, and may have a semi-elliptical shape or any other curved shape.

The wick 20 is disposed in a central portion of the container 10 in the width direction Y. Also, the wick 20 (a first wick 21) is fixed to the first flat surface 10*a*. A gap is formed between the wick 20 and the second flat surface 10*b*. Also, gaps are formed between the wick 20 and the pair of curved surfaces 10*c*. These gaps serve as a vapor flow path 11 for the working fluid. Further, the wick 20 (the first wick 21) may be fixed to the second flat surface 10*b* instead of the first flat surface 10*a*.

As illustrated in FIG. 1, the wick 20 extends in the longitudinal direction X. The wick 20 serves as a liquid flow path for the working fluid. A heating element 30 is in contact with at least a portion of an outer surface of the container 10 through a thermal interface material (TIM) such as heat dissipation grease 31. The heating element 30 is positioned at the first end portion 10*d*. Also, a heat sink 40 is in contact with at least a portion of the outer surface of the container 10 through a TIM such as heat dissipation grease 41. The heat sink 40 is positioned at the second end portion 10*e*.

The working fluid evaporates in an evaporation section 10A positioned at the first end portion 10*d* of the container 10. Also, the working fluid is condensed in a condensation section 10B positioned at the second end portion of the container 10. The wick 20 recirculates the working fluid that has been evaporated in the evaporation section 10A and condensed in the condensation section 10B to the evaporation section 10A again.

As illustrated in FIG. 2, the wick 20 includes the first wick 21 having a plurality of first voids and a second wick 22 having a plurality of second voids. The first wick 21 rises from a flat surface (the first flat surface 10*a* in one or more embodiments) and is fixed to the flat surface (the first flat surface 10*a* in one or more embodiments). The second wick 22 covers a surface of the first wick 21.

The first wick 21 is formed of a plurality of fine wires 21*a* bundled together. For the fine wires 21*a*, for example, a metal wire made of such as copper, aluminum, or stainless steel, or a non-metal wire such as carbon fibers or glass fibers may be employed. Further, since a metal wire has high thermal conductivity, it may be suitably employed for the fine wires 21*a*. Further, as a material for the fine wires 21*a*, a material having excellent wettability in relation to the working fluid sealed in the internal space S of the container 10 may be selected.

The fine wire 21*a* of one or more embodiments is, for example, copper wire having a diameter of about 50 μm. A plurality of fine wires 21*a* are bundled to constitute the first wick 21. A maximum value t1 of a dimension of the first wick in the thickness direction Z (maximum thickness t1 of the first wick 21) is, for example, about 1 mm when a dimension of the internal space S in the thickness direction Z is 2 mm. Further, in the first wick 21, a plurality of fine wires 21*a* that are bundled may be twisted or may not be twisted.

The second wick 22 is formed of a sintered body (porous sintered body) of powders 22*a*. For the powder 22*a*, for example, metallic powder such as copper or non-metallic powder such as a ceramic may be employed. Further, since metallic powder has high thermal conductivity, it may be suitably employed for the powder 22*a*. Further, as a material of the powder 22*a*, a material having excellent wettability in relation to the working fluid sealed in the internal space S of the container 10 may be selected.

The powder 22*a* of one or more embodiments is, for example, copper powder having a particle size of 20 μm or less. When the powders 22*a* are sintered, the second wick 22 (powder wick) having substantially a constant dimension in the thickness direction Z is formed. Further, "substantially constant" also includes a case in which the dimension in the thickness direction Z may be regarded as constant if a manufacturing error is removed. A maximum value t2 of the dimension of the second wick 22 in the thickness direction Z (maximum thickness t2 of the second wick 22) is, for example, about 0.2 mm when the maximum thickness t1 of the first wick 21 is 1 mm.

The second voids formed around each of a plurality of copper powder particles forming the second wick 22 are finer than the first voids formed around each of the plurality of copper wires forming the first wick 21. Such a difference in size between the first void and the second void is caused by a difference between a particle size of the powder 22*a* forming the second wick 22 and a diameter of the fine wire 21*a* forming the first wick 21. That is, in a cross-sectional view of the wick 20, each of the plurality of second voids (porous) is smaller on average than each of the plurality of first voids (spaces between the fine wires 21*a*). The second wick 22 has a higher capillary force than the first wick 21. In other words, the first wick 21 has a higher liquid permeability than the second wick 22.

As illustrated in FIG. 1, the first wick 21 extends in the internal space S of the container 10 from the evaporation section 10A in which the working fluid evaporates to the condensation section 10B in which the working fluid condenses. The second wick 22 covers the surface of the first wick 21 at least in the evaporation section 10A (in one or more embodiment, the entire first wick 21). Further, the second wick 22 may penetrate a first layer (between the fine wires 21*a* forming an outermost circumference of the first wick 21) on the surface of the first wick 21, but does not penetrate a second layer or below of the first wick 21, that is, at least from an intermediate layer to a lowermost layer of the first wick 21.

The second wick 22 is in contact with the first wick 21, and a liquid is capable of flowing back and forth between the two wicks 21 and 22. That is, in the condensation section 10B, the condensed working fluid (liquid) is absorbed from a surface of the second wick 22 having a high capillary force and permeates through the first wick 21. Also, in the evaporation section 10A, a liquid that has mainly flowed through the first wick 21 having a low pressure loss exudes to the second wick 22 side and evaporates on the surface of the second wick 22.

According to the heat pipe 1 having the above-described configuration, the surface of the first wick 21 is covered with the sintered body of the powders 22*a* (the second wick 22) having the second voids finer than the first voids. The surface of the second wick 22 has unevenness formed to be finer than the surface of the first wick 21, and thus it is possible to increase an evaporation area of the working fluid and it is possible to reduce thermal resistance. Also, since the condensed working fluid flows not only in the first wick 21 (the first voids) but also in the second wick 22 (the second voids), a maximum amount of heat transport increases.

Figures 3, 4:
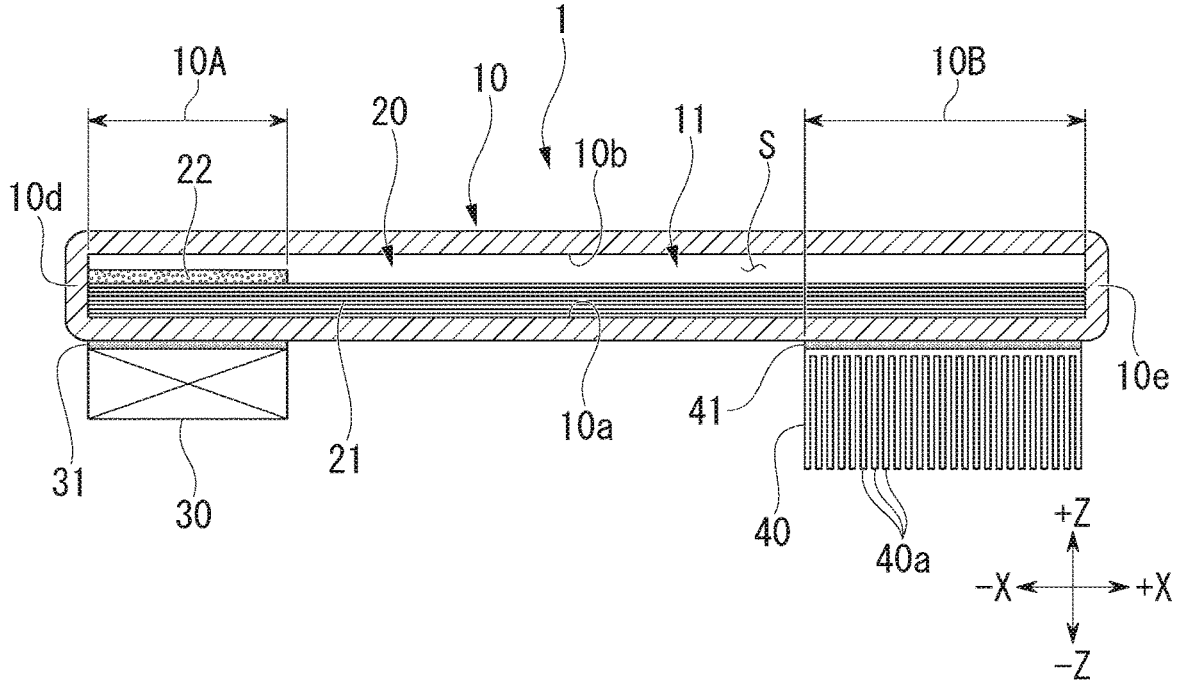
FIG. 3 is a diagram showing a result in which performances of a new wick according to one or more embodiments and performances of a conventional wick are compared.
FIG. 4 is a view illustrating a cross-sectional configuration of a heat pipe according to one modified example.

FIG. 3 is a diagram showing a result in which performances of the new wick 20 according to one or more embodiments and a conventional wick are compared.

As shown in FIG. 3, in the heat pipe 1 including the new wick 20 described above, thermal resistance of the evaporation section 10A is reduced to one-third compared to that in the conventional wick with only the first wick 21 described above. Also, the heat pipe 1 including the new wick 20 has a maximum amount of heat transport increased by 30% compared to the conventional wick.

In this way, according to one or more embodiments described above, it is possible to improve performance of the heat pipe 1 by employing a configuration including the flat container 10 having the internal space S in which the working fluid is sealed and the flat surface (the first flat surface 10*a*) facing the internal space S, and the first wick 21 having the plurality of first voids and the second wick 22 having the plurality of second voids which are provided in the internal space S, in which the first wick 21 rises from the flat surface (the first flat surface 10*a*) and is fixed to the flat surface (the first flat surface 10*a*), the second wick 22 is formed of the sintered body of the powders 22*a* and covers the surface of the first wick 21, and each of the plurality of second voids is smaller on average than each of the plurality of first voids.

Also, in the heat pipe 1 of one or more embodiments, the first wick 21 is formed of a plurality of fine wires 21*a* bundled together. According to this configuration, it is possible to exhibit a high capillary force, and it is possible to reduce a pressure loss of the condensed working fluid.

Also, in the heat pipe 1 of one or more embodiments, a diameter of the fine wire 21*a* is larger than a particle size of the powder 22*a*. According to this configuration, it is possible to make the first voids larger than the second voids easily, and it is possible to reduce a pressure loss of the liquid flowing through the first wick 21.

Also, in the heat pipe 1 of one or more embodiments, the maximum thickness t1 of the first wick 21 is larger than the maximum thickness t2 of the second wick 22. According to this configuration, it is possible to prevent a spatial area of the vapor flow path 11 around the second wick 22 from being reduced while securing a large spatial area of the first wick 21 in which a pressure loss of the condensed working fluid is low.

Also, in the heat pipe 1 of one or more embodiments, the first wick 21 extends in the internal space S of the container 10 from the evaporation section 10A in which the working fluid evaporates to the condensation section 10B in which the working fluid condenses, and the second wick 22 covers the surface of the first wick 21 at least in the evaporation section 10A. According to this configuration, it is possible to reduce thermal resistance at least in the evaporation section 10A. Further, as illustrated in the modified example illustrated in FIG. 4, the second wick 22 may cover the surface of the first wick 21 only in the evaporation section 10A.

While one or more embodiments of the present invention have been described and explained above, it should be understood that these are exemplary of the present invention and are not to be considered as limiting. Additions, omissions, substitutions, and other modifications can be made without departing from the scope of the present invention. Accordingly, the present invention is not to be considered as being limited by the foregoing description and is only limited by the scope of the claims.

For example, the first wick 21 may be a powder wick similarly to the second wick 22.

REFERENCE SIGNS LIST

1 Heat pipe
10 Container
10*a* First flat surface (flat surface)
10A Evaporation section
10B Condensation section
20 Wick
21 First wick
21*a* Fine wire
22 Second wick
22*a* Powder
S Internal space

What is claimed is:

1. A heat pipe comprising:
a flat container having an internal space in which a working fluid is sealed and a flat surface facing the internal space, and
a wick disposed in the internal space,
wherein
the wick includes a first wick having first voids and a second wick having second voids,
the first wick rises from the flat surface and is fixed to the flat surface,
the second wick is formed of a sintered body of powders and covers a surface of the first wick,
each of the second voids is smaller on average than any of the first voids,
the second wick does not cover the surface of the first wick in a condensation section in which the working fluid condenses,
the second wick has:
a first end in a width direction; and
a second end opposite the first end in the width direction,
the first end and the second end are in contact with the flat surface, and
a portion of an inner circumferential surface of the flat container that is not in contact with any one of the first wick, the first end, and the second end is exposed to the internal space.

2. The heat pipe according to claim 1, wherein the first wick is formed of fine wires bundled together.

3. The heat pipe according to claim 2, wherein diameters of the fine wires are larger than particle sizes of the powders.

4. The heat pipe according to claim 1, wherein,
a thickness direction is defined as a direction perpendicular to the flat surface, and a maximum value of a dimension of the first wick in the thickness direction is larger than a dimension of the second wick in the thickness direction.

5. The heat pipe according to claim 1, wherein the first wick extends in the internal space from an evaporation section in which the working fluid evaporates to the condensation section, and the second wick covers the surface of the first wick in the evaporation section.

* * * * *